US008503920B2

(12) United States Patent
Kashiwakura et al.

(10) Patent No.: US 8,503,920 B2
(45) Date of Patent: Aug. 6, 2013

(54) IMAGE FORMING APPARATUS HAVING CLEANING BLADE AND METHOD FOR SELECTING MATERIAL OF CLEANING BLADE

(75) Inventors: Kuniaki Kashiwakura, Toyohashi (JP); Yoshiki Nakane, Toyokawa (JP); Ikuko Kanazawa, Hino (JP)

(73) Assignee: Konica Minolta Business Technologies, Inc., Chiyoda-ku, Tokyo (JP)

( * ) Notice: Subject to any disclaimer, the term of this patent is extended or adjusted under 35 U.S.C. 154(b) by 120 days.

(21) Appl. No.: 13/062,709

(22) PCT Filed: Aug. 14, 2009

(86) PCT No.: PCT/JP2009/064354

§ 371 (c)(1),
(2), (4) Date: Mar. 8, 2011

(87) PCT Pub. No.: WO2010/032571

PCT Pub. Date: Mar. 25, 2010

(65) Prior Publication Data

US 2011/0164908 A1 Jul. 7, 2011

(30) Foreign Application Priority Data

Sep. 17, 2008 (JP) ..... 2008-237634

(51) Int. Cl.
*G03G 21/00* (2006.01)

(52) U.S. Cl.
USPC ..... 399/350

(58) Field of Classification Search
USPC ..... 399/350
See application file for complete search history.

(56) References Cited

U.S. PATENT DOCUMENTS 7,471,924 B2 12/2008 Shigezaki et al.
2005/0220514 A1* 10/2005 Hisakuni ..... 399/350

(Continued)

FOREIGN PATENT DOCUMENTS

EP 1 245 602 A1 10/2002
JP 2000147970 A * 5/2000

(Continued)

OTHER PUBLICATIONS

Notification of Transmittal of Copies of Translation of the International Preliminary Report on Patentability (Forms PCT/IB/338 and PCT/IB/373) and the Written Opinion of the International Searching Authority (Form PCT/ISA/237) issued on Apr. 28, 2011, in the corresponding International Application No. PCT/JP2009/064354.

(Continued)

*Primary Examiner* — Quana M Grainger
(74) *Attorney, Agent, or Firm* — Buchanan Ingersoll & Rooney PC

(57) ABSTRACT

An image forming apparatus includes an image carrying member which carries an image composed of a developer, a lubricant application device which applies a lubricant onto the image carrying member, and a cleaning blade which abuts against the image carrying member to scrape the developer. The cleaning blade is formed of a material whose tensile stress-elongation test shows that the definite integral of a tensile stress with respect to an elongation percentage on an interval between the elongation percentage of zero and the elongation percentage at which the stress is a predetermined value is a predetermined upper limit value or less.

3 Claims, 12 Drawing Sheets

U.S. PATENT DOCUMENTS

| | | | | |
|---|---|---|---|---|
| 2006/0216084 | A1 | 9/2006 | Kojima et al. | |
| 2007/0212630 | A1 * | 9/2007 | Yasunaga et al. | 430/108.7 |
| 2008/0181689 | A1 | 7/2008 | Fujimori | |
| 2009/0290921 | A1 * | 11/2009 | Mochizuki et al. | 399/350 |

FOREIGN PATENT DOCUMENTS

| | | | |
|---|---|---|---|
| JP | 2003-58009 | A | 2/2003 |
| JP | 2006-267299 | A | 10/2006 |
| JP | 2007-57833 | A | 3/2007 |
| JP | 2008-197249 | A | 8/2008 |

OTHER PUBLICATIONS

Supplementary European Search Report dated Mar. 2, 2012, issued in the corresponding European Patent Application No. 09814416.5. (7 pages).

International Search Report (PCT/ISA/210) issued on Sep. 15, 2009, by Japanese Patent Office as the International Searching Authority for International Application No. PCT/JP2009/064354.

* cited by examiner

*Fig. 16*

| MATERIAL | STRESS-ELONGATION INTEGRAL VALUE | HARDNESS | IMPACT RESILIENCE | RESULT OF DURABILITY TEST | | |
|---|---|---|---|---|---|---|
| | | | | $\mu$ =0.2 | $\mu$ =0.25 | $\mu$ =0.35 |
| 1 | 134.7 | 80 | 29 | ○ | ○ | ○ |
| 2 | 184.2 | 77 | 27 | ○ | ○ | ○ |
| 3 | 190.8 | 78 | 46 | ○ | ○ | ○ |
| 4 | 207.2 | 78 | 25 | ○ | ○ | ○ |
| 5 | 216.9 | 75 | 40 | ○ | ○ | ○ |
| 6 | 223.2 | 76 | 34 | ○ | ○ | ○ |
| 7 | 232.6 | 77 | 32 | ○ | ○ | ○ |
| 8 | 243.3 | 77 | 53 | ○ | ○ | ○ |
| 9 | 255.5 | 72 | 25 | ○ | ○ | ○ |
| 10 | 292.5 | 70 | 21 | ○ | ○ | ○ |
| 11 | 305.8 | 74 | 50 | △ | △ | ○ |
| 12 | 316.6 | 70 | 40 | × | △ | ○ |
| 13 | 321.9 | 77 | 48 | × | × | ○ |
| 14 | 431.1 | 67 | 55 | × | × | △ |
| 15 | 583.9 | 67 | 51 | × | × | × |

| MATERIAL | STRESS-ELONGATION INTEGRAL VALUE | RESULT OF DURABILITY TEST | | | |
|---|---|---|---|---|---|
| | | 3° | 5° | 10° | 15° |
| 2 | 184.2 | △ | ○ | ○ | ○ |
| 6 | 223.2 | △ | ○ | ○ | ○ |
| 9 | 255.5 | × | ○ | ○ | △ |
| 11 | 305.8 | △ | ○ | △ | × |
| 12 | 316.6 | × | ○ | △ | × |
| 13 | 321.9 | △ | ○ | × | × |
| 15 | 583.9 | × | × | × | × |

IMAGE FORMING APPARATUS HAVING CLEANING BLADE AND METHOD FOR SELECTING MATERIAL OF CLEANING BLADE

TECHNICAL FIELD

The present invention relates to an image forming apparatus and a method for selecting a material of a cleaning blade.

BACKGROUND ART

Image forming apparatus, which applies a lubricant to an image carrying member and presses a cleaning blade made of urethane rubber or the like against the image carrying member to scrape a developer remaining on the image carrying member, are publicly known. In the cleaning blade, a tip section abutting against the image carrying member is deformed to form a nip between the image carrying member and the cleaning blade.

When deformation of the tip section of the cleaning blade is large, a frictional force between the tip section and the image carrying member is large, and a location different from an inherent edge may be worn to fracture the tip section of the cleaning blade and a life of the cleaning blade may be shortened. Therefore, it is required to select a material in which an elongation percentage under tensile stress is low to a certain degree for the cleaning blade.

Conventionally, in selecting a material of the cleaning blade, the propriety of using as a material of a cleaning blade has been determined by stress (modulus) at which predetermined elongation is recorded in a tensile-elongation test. In Patent Document 1, 300% modulus (stress value at the time when elongation is 300%) is used as a measure of selecting a material of the cleaning blade. Further, in Patent Document 2, 100% modulus is used as a parameter to select a material of the cleaning blade.

However, in actual cleaning blades, since stress is nonuniformly distributed to act on the cleaning blade, it was impossible to correctly evaluate the suitability of a material as a cleaning blade by just the modulus. Consequently, in the conventional image forming apparatuses, a life of the cleaning blade might be shorter than a predicted life.

Patent Document 1: Japanese Unexamined Patent Publication No. 2003-58009

Patent Document 2: Japanese Unexamined Patent Publication No. 2006-267299

DISCLOSURE OF THE INVENTION

Problems To Be Solved By The Invention

In view of the above problem, it is an object of the present invention to provide a method for selecting a material with accurately evaluating suitability as a material of the cleaning blade, and an image forming apparatus having a long-life cleaning blade.

Means For Solving The Problems

To solve the above-mentioned problem, an image forming apparatus according to the present invention has an image carrying member which carries an image composed of a developer, a lubricant application device which applies a lubricant onto the image carrying member, and a cleaning blade which abuts against the image carrying member to scrape the developer, wherein the cleaning blade is formed of a material whose tensile stress-elongation test shows that the definite integral of a tensile stress with respect to an elongation percentage on an interval between the elongation percentage of zero and the elongation percentage at which the stress is a predetermined value is a predetermined upper limit value or less.

In the image forming apparatus, stress which has a peak and is not uniform acts on the vicinity of an edge of the cleaning blade in a distributed manner. Since the integral value of a tensile stress with respect to an elongation percentage is a value representing elongations of a material in a certain range of low stress region instead of stress of a certain point, it has a high correlation with the deformation amount based on a stress distribution which actually acts on the cleaning blade in using the cleaning blade for an image carrying member having a low friction coefficient. By using the material showing that the integral value of a tensile stress with respect to elongation is small for a cleaning blade to decrease a deformation amount of the cleaning blade in actual usage, it is possible to reduce wearing of the cleaning blade and to achieve a long-life cleaning blade and images of high quality.

In the image forming apparatus according to the present invention, the predetermined stress is about 5 MPa and the upper limit may be approximately 300 MPa·%.

In accordance with this constitution, the integral value of a tensile stress with respect to an elongation percentage corresponding to the stress of 5 MPa has a high correlation with stress which acts on the cleaning blade in a normal condition when the cleaning blade is pressed against the photoconductor to which a lubricant is applied. Further, when this integral value is 300 MPa·% or the less, a location of wearing of the cleaning blade is not away from an edge of the blade, and therefore it does not occur that the edge is wrested away after the wearing proceeds to shorten a life of the cleaning blade.

In the image forming apparatus according to the present invention, a contact angle of the cleaning blade relative to the image carrying member (angle between a direction of a tangent line on a downstream side in the image carrying member and a side surface of the cleaning blade) is 5° or more and 15° or less.

The deformation amount of the cleaning blade is smaller with smaller contact angle of the cleaning blade, and thereby a life of the cleaning blade can be lengthened. However, when the contact angle of the cleaning blade is less than 5°, since a side surface of the cleaning blade abuts against the image carrying member, the edge of the blade cannot be pressed against the image carrying member, and therefore the developer cannot be scraped. Accordingly, by employing the contact angle described above, the life of the cleaning blade can be lengthened.

According to the present invention, a method for selecting a material of a cleaning blade which abuts against an image carrying member to which a lubricant is applied to scrape a developer, comprises selecting a material whose tensile stress-elongation test shows that the definite integral of a tensile stress with respect to an elongation percentage on an interval between the elongation percentage of zero and the elongation percentage at which the stress is a predetermined value is a predetermined upper limit value or less.

In accordance with this method, since a material of the cleaning blade is selected using, as a measure, the integral value with respect to an elongation percentage, of a tensile stress having a high correlation with the deformation amount under a stress distribution which actually acts on the cleaning blade in using the cleaning blade for an image carrying member having a low friction coefficient, it is possible to provide a long-life cleaning blade which has a small deformation amount of the cleaning blade in actual usage and hardly wears.

EFFECT OF THE INVENTION

As described above, in accordance with the present invention, since the cleaning blade is formed of the material which shows that the integral value of a tensile stress with respect to an elongation percentage corresponding to a predetermined pressure of the stress in the tensile test is small, the deformation amount of the cleaning blade during usage is small, and wearing of the cleaning blade is not away from the edge of the blade and therefore the cleaning blade does not cause abnormal wearing, and consequently a life of the cleaning blade is long.

BRIEF DESCRIPTION OF THE DRAWINGS

FIG. 16 is a table showing integral values of stress-elongation and states of cleaning after a durability test.

BEST MODE FOR CARRYING OUT THE INVENTION

Figure 1:
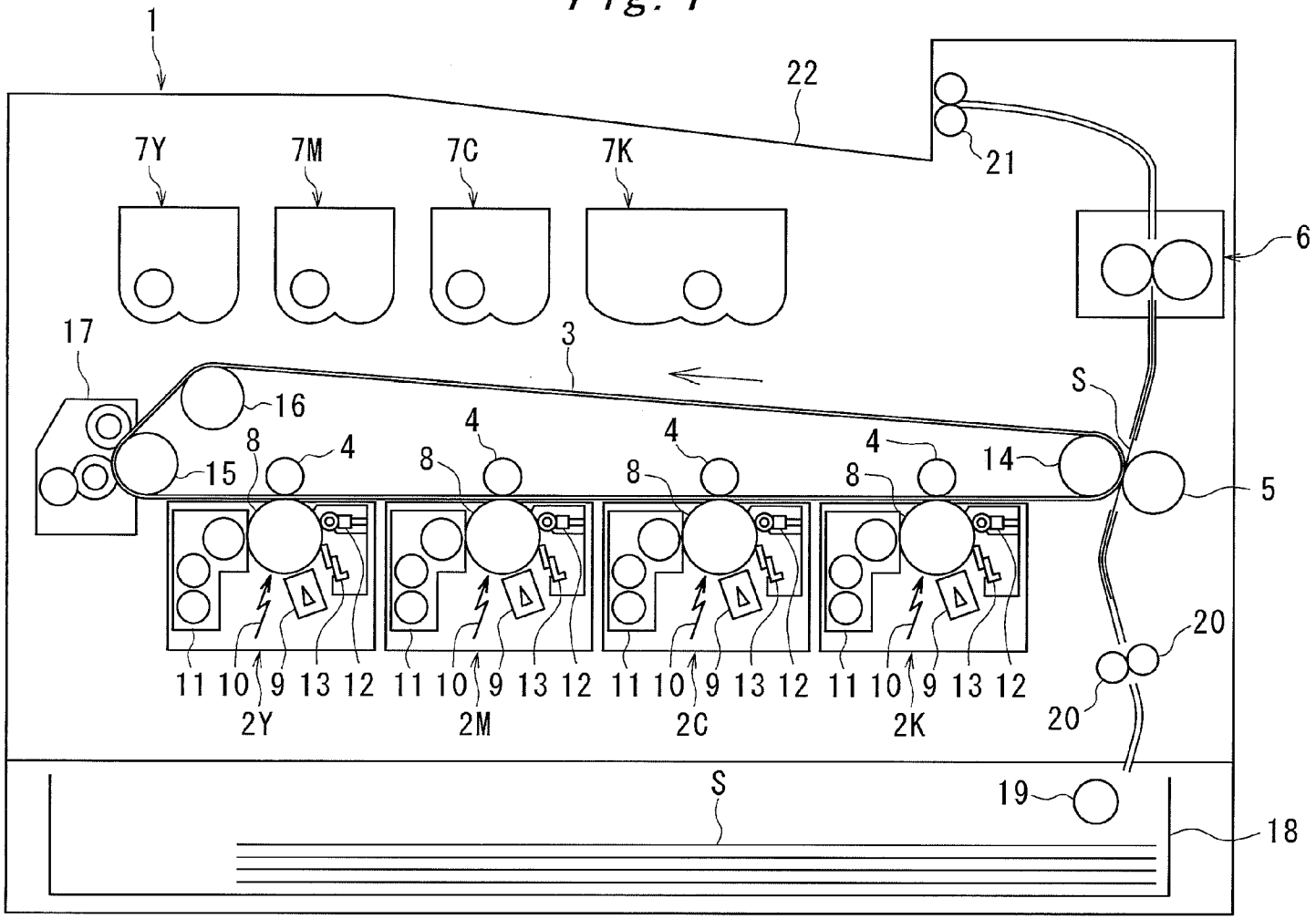
FIG. 1 is a schematic view of an image forming apparatus of an embodiment of the present invention.

Hereinafter, embodiments of the present invention will be described referring to the drawings. FIG. 1 shows an image forming apparatus 1 of a first embodiment of the present invention. The image forming apparatus 1 has four developing units 2Y, 2M, 2C, and 2K which form an image by toners (developers) of yellow, magenta, cyan, and black, respectively, having negative charges, a transfer belt 3, a primary transfer roller 4 to transfer toner images which the developing units 2 form to the transfer belt 3 through an electrostatic force, a secondary transfer roller 5 to transfer toner images transferred to the transfer belt 3 to a recording paper S through an electrostatic force, a fixing device 6 to fix the toner images by heating the recording paper S, and four toner cartridges 7Y, 7M, 7C, and 7K to supply toners of yellow, magenta, cyan, and black, respectively, to the developing units 2.

Each of the developing units 2Y, 2M, 2C, 2K has a drum-shaped rotating photoconductor (image carrying member) 8, a charging unit 9 electrically charging the photoconductor 8, an exposure unit 10 which selectively exposures the charged photoconductor 8 to form an electrostatic latent image, a developing unit 11 which supplies toner T to the electrostatic latent image to form toner images, a lubricant application device 12 which applies a lubricant onto the surface of the photoconductor 8, and a cleaner 13 to scrape the toner on the surface of the photoconductor 8.

A transfer belt 3 is looped over a drive roller to be rotationally driven, a driven roller 15 and a tension roller 16 to give tension and the transfer belt 3 is moved around these rollers in a direction of an arrow by the driving roller 14. Further, the image forming apparatus 1 has a cleaner unit 17 which removes toner remaining on the surface of the transfer belt 3.

The recording papers S are supplied to a paper feeding section 18, sent out one by one by a supply roller 19, conveyed to a secondary transfer roller 5 by a conveying roller 20, passes through a fixing device 6, and discharged to a paper-discharging section 22 by a paper-discharging roller 21.

Figure 2:
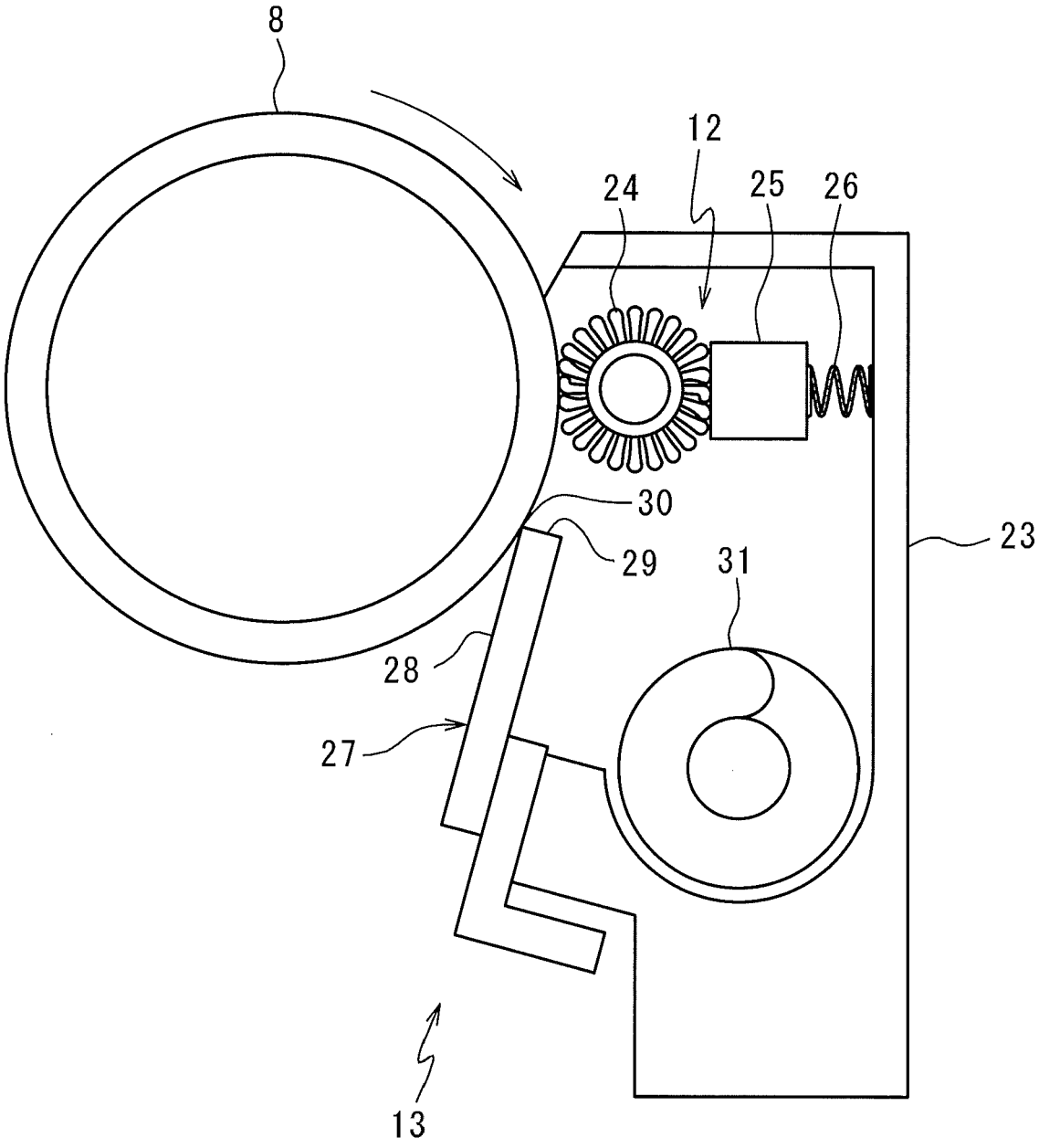
FIG. 2 is a detail view of a photoconductor, a lubricant application device and a cleaner of the image forming apparatus of FIG. 1.

Details of the photoconductor 8, the lubricant application device 12 and the cleaner 13 are shown in FIG. 2. The lubricant application device 12 and the cleaner 13 have a common housing 23. The lubricant application device 12 has a brush roller 24 having looped threads implanted in an outer surface of a shaft without having an end portion, a solid lubricant 25 formed by solidifying, for example, zinc stearate, and a biasing member 26 which presses the solid lubricant 25 against a brush roller 24 with a predetermined force (per unit length) (for example, 2 N/m).

The photoconductor 8 has an overcoat layer having a thickness of about 5 μm in which $SiO_2$ fine particles having a particle diameter of about 50 nm are uniformly dispersed in order to have a smooth surface.

The cleaner 13 is constructed so as to press the cleaning blade 27 composed of urethane rubber, for example, more specifically, the edge (corner) 30 which is formed by the side surface 28 of the blade forms and the tip face 29, against the surface of the photoconductor 8 with a pressing force (per unit length) of 25 N/m, for example, to scrape the toner remaining on the photoconductor 8.

In the lubricant application device 12, the brush roller 24 shaves the surface of the solid lubricant 25 which is pressed against brush roller 24 by a biasing member 26, through its rotation, and applies the shaved lubricant onto the surface of the photoconductor 8.

The lubricant applied onto the surface of the photoconductor 8 passes through a nip between the cleaning blade 27 and the photoconductor 8 with rotations of the photoconductor 8 to reduce the friction between the cleaning blade 27 and the photoconductor 8. On the other hand, toner having a larger particle than that of the lubricant is scraped from the photoconductor 8 by the cleaning blade 27.

Further, the cleaner 13 has a screw 31 for conveying the scraped toner to an unshown waste toner bottle.

Figure 3:
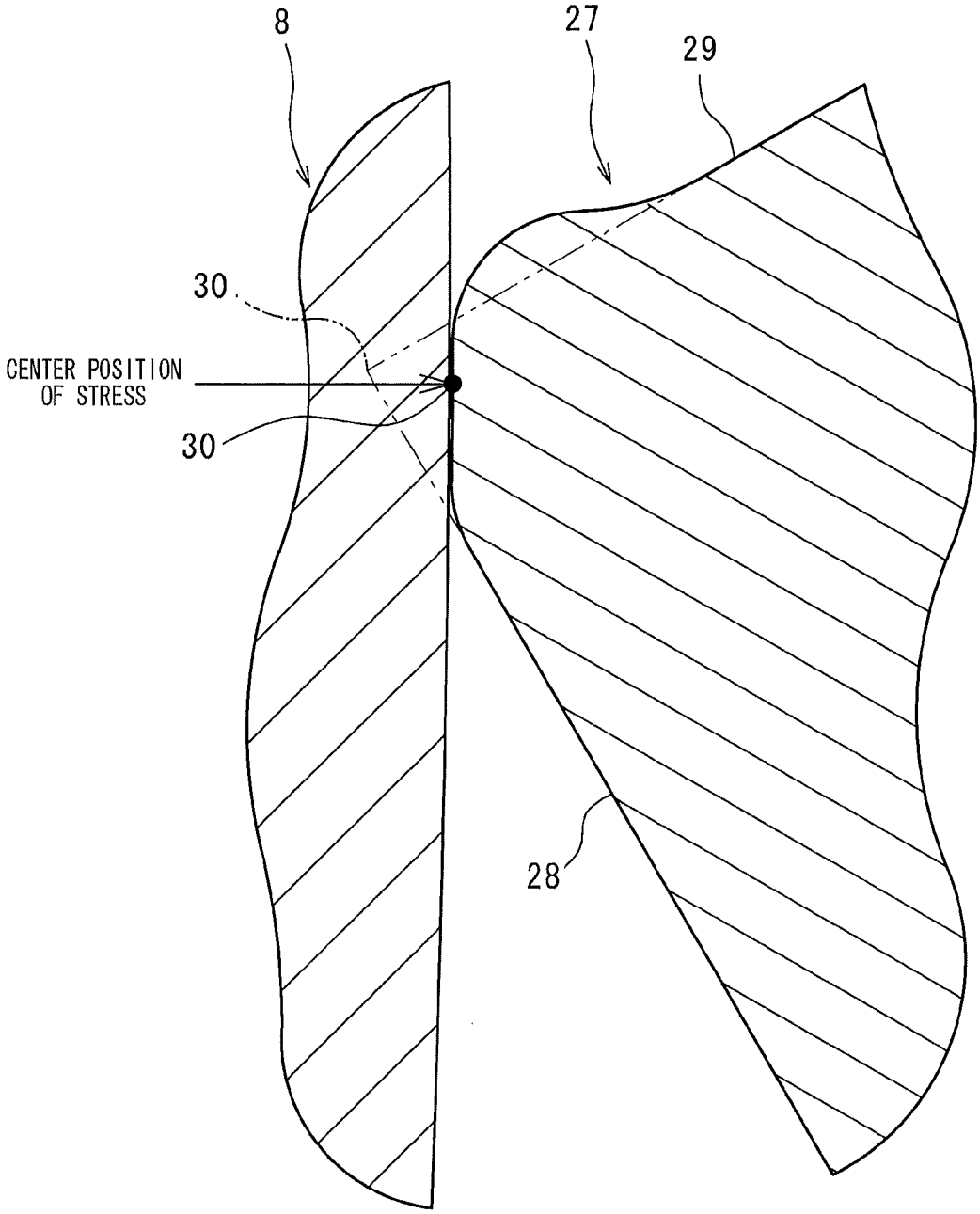
FIG. 3 is an enlarged view of a cleaning blade tip section abutting against the photoconductor of FIG. 2.

A nip portion between the photoconductor 8 and the cleaning blade 27 is shown in more detail in FIG. 3. An edge 30 of the cleaning blade 27 is pressed against the photoconductor 8 and the vicinity of the edge 30 is flattened. In this time, stress acts on the vicinity of the edge 30 in a distributed manner so as to peak at the position of the edge 30 of the cleaning blade 27.

Figure 4:
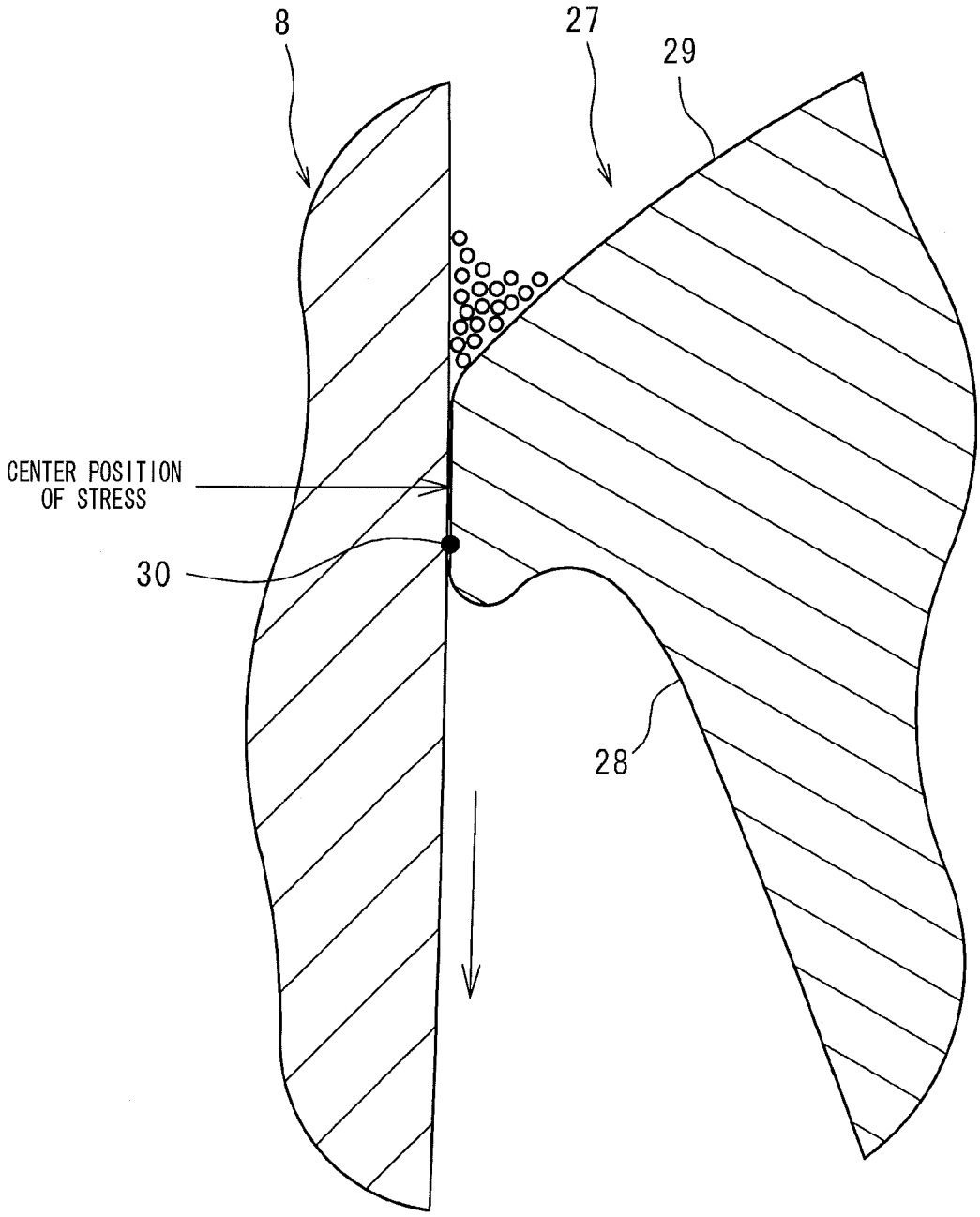
FIG. 4 is an enlarged view of a cleaning blade tip section during the photoconductor rotates.

Furthermore, when the photoconductor 8 is rotated in a direction indicated by an arrow, as shown in FIG. 4, the cleaning blade 27 is deformed by a frictional force between the cleaning blade 27 and the photoconductor 8 so as to draw the edge 30 to a side of the surface 28 (downstream side in a rotation direction of the photoconductor 8). Thereby, a stress distribution which acts on the cleaning blade 27 is shifted from the position of the edge 30 to a side of a tip face 29 (upstream side in a rotation direction of the photoconductor 8).

Such the deformation tends to be produced when an apparent friction coefficient (for example, a value measured by using a slider on which a cotton flannel cloth is bonded with Portable Friction Meter Muse Type 94i-II manufactured by Shinto Scientific Co., Ltd.) of the surface of the photoconductor 8 is small, particularly 0.25 or less. It is thought that since the surface of the photoconductor 8 becomes specular, effective friction of the photoconductor 8 with the cleaning blade 27 is rather increased.

Figure 5:
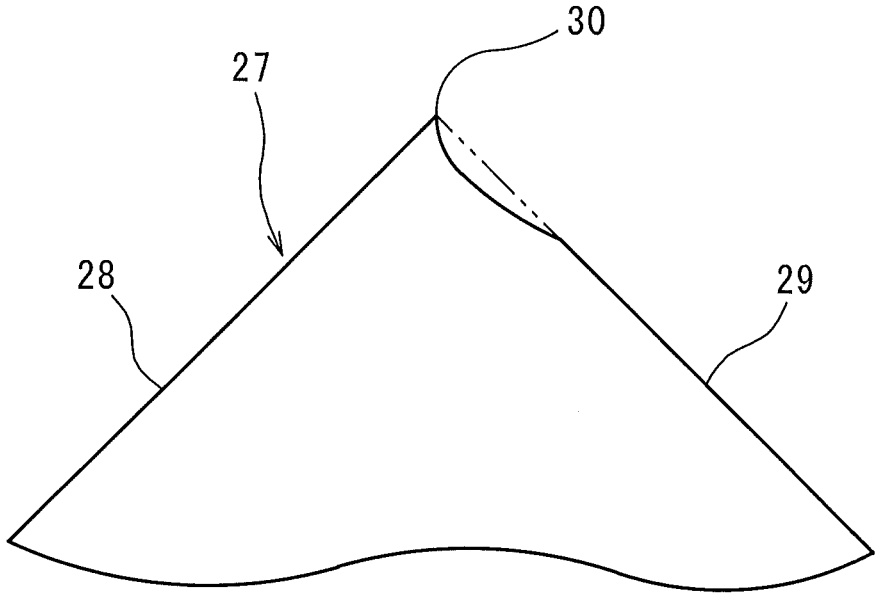
FIG. 5 is a view showing normal initial wear of the cleaning blade.
Figure 6:
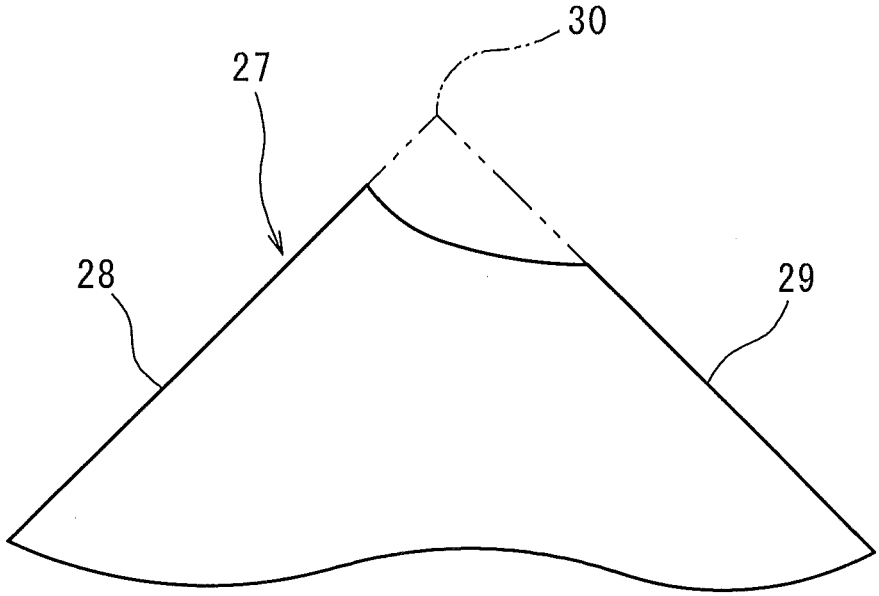
FIG. 6 is a view showing normal ongoing wear of the cleaning blade.

Therefore, if the image forming apparatus 1 is operated, in the tip face 29 of the cleaning blade 27, as shown in FIG. 5, wearing proceeds around the vicinity of the edge 30 of the tip face 29 according to received stress. When the wearing proceeds, the edge 30 is gradually chipped off from a tip face 29 side, as shown in FIG. 6.

Figure 7:
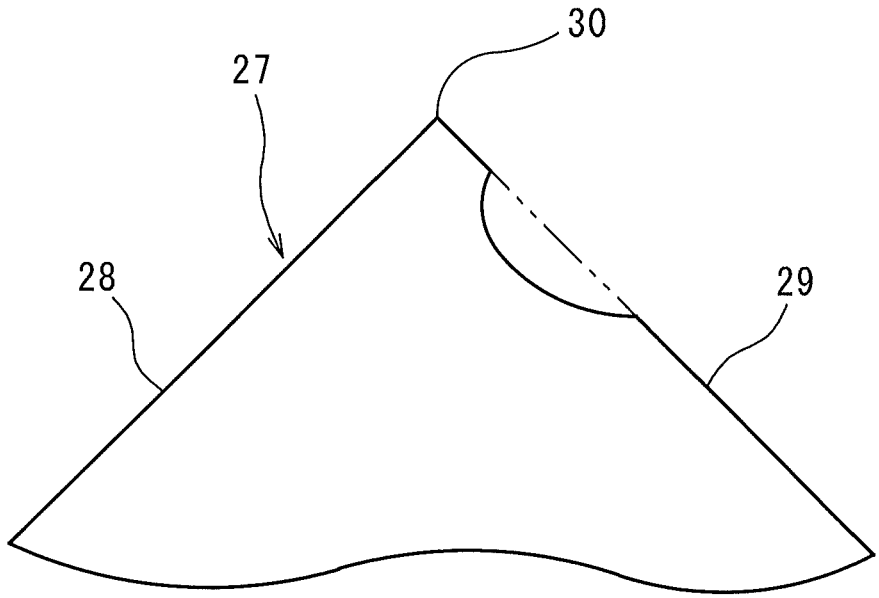
FIG. 7 is a view showing abnormal initial wear of the cleaning blade.
Figure 8:
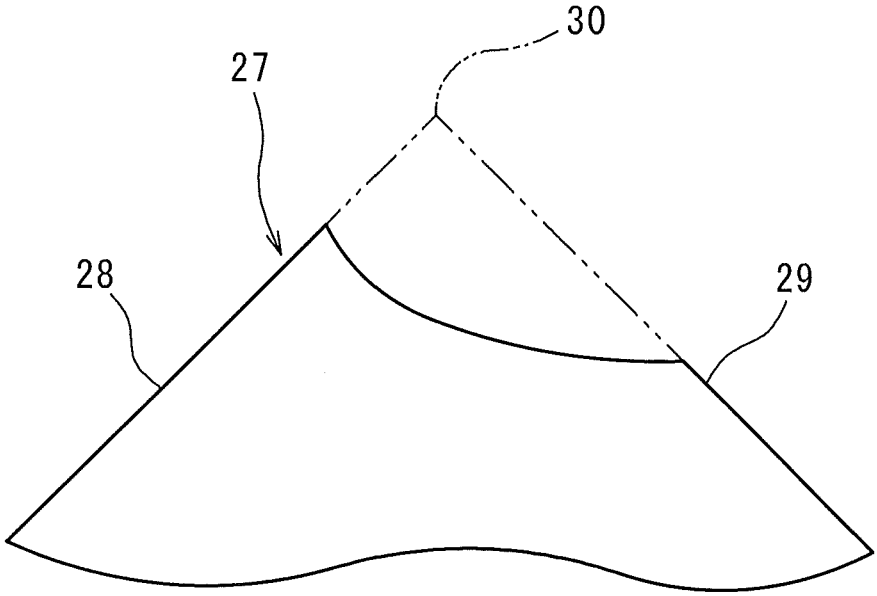
FIG. 8 is a view showing abnormal ongoing wear of the cleaning blade.

When the apparent friction coefficient of the photoconductor 8 is low and an effective frictional force between the cleaning blade 27 and the photoconductor 8 is large, the tip section of the cleaning blade 27 is deformed by a large amount. In this case, as shown in FIG. 7, wearing of the cleaning blade 27 takes place around a location away from the edge 30 of the tip face 29. When this wearing proceeds, since a lower portion of the edge 30 is scratched out and the edge 30 is fractured in a wrested manner, the tip section of the cleaning blade 27 is worn by a large amount, as shown in FIG. 8.

Figure 9:
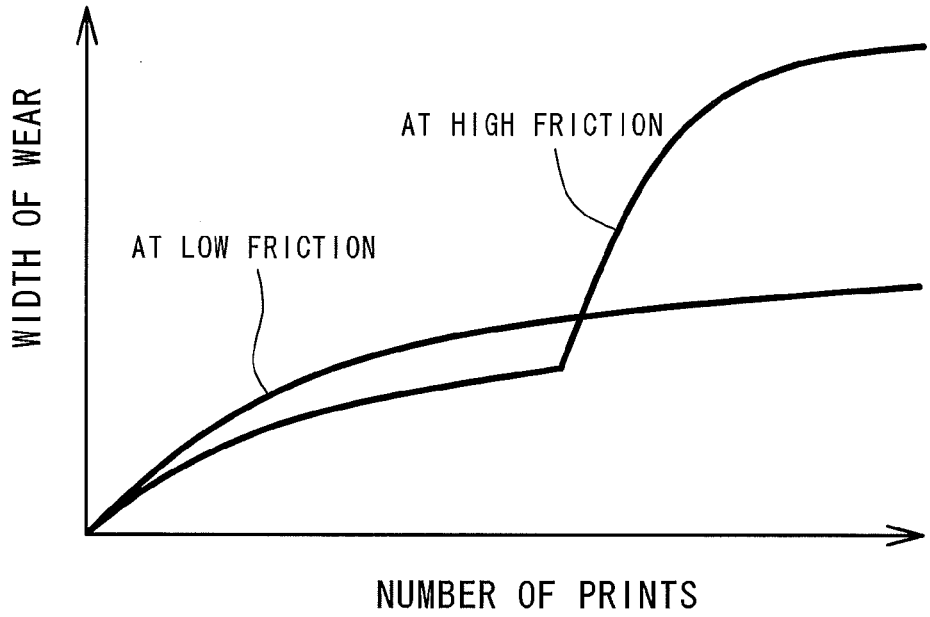
FIG. 9 is a graph showing a relationship between number of prints and increasing width of wear.

The proceeding of these wears of the cleaning blade 27 is represented by a width of wear in FIG. 9. When the frictional force between the cleaning blade 27 and the photoconductor 8 is large, that is, when the deformation amount of the cleaning blade 27 is large, since the edge 30 is wrested at a certain time point, the width of wear rapidly increases in a discontinuous manner. If such the wearing takes place, the cleaning blade 27 cannot adequately scrape the toner from the photoconductor 8.

Figure 10:
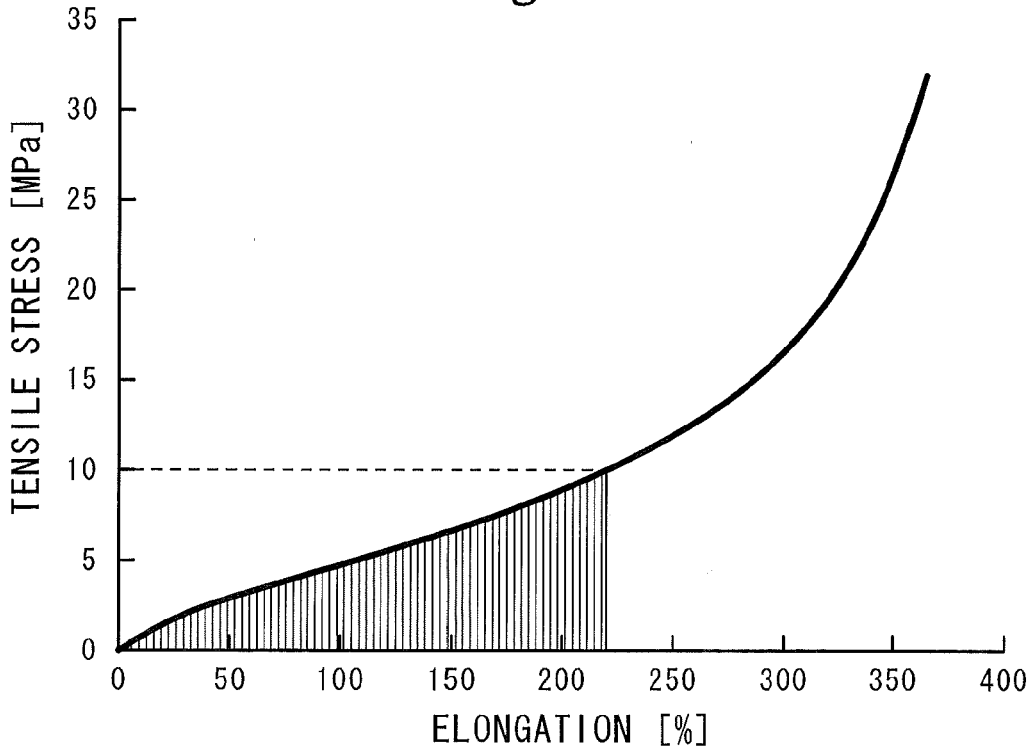
FIG. 10 is a graph showing measurement examples of a tensile stress-elongation test.
Figure 11:
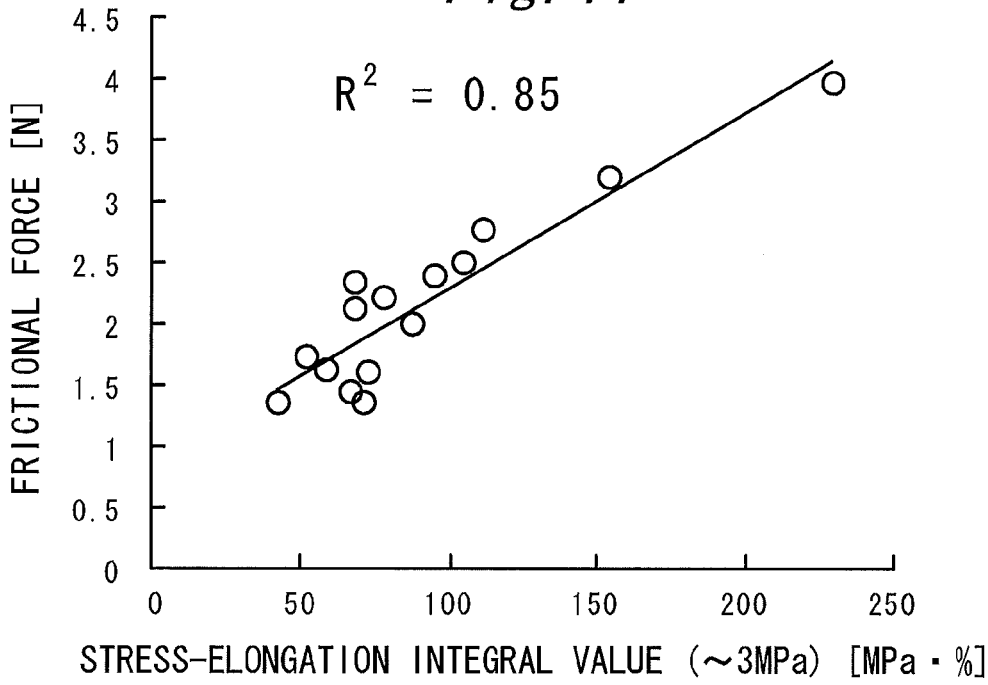
FIG. 11 is a graph showing a correlation between an integral value of stress-elongation up to 3 MPa and a frictional force.
Figure 12:
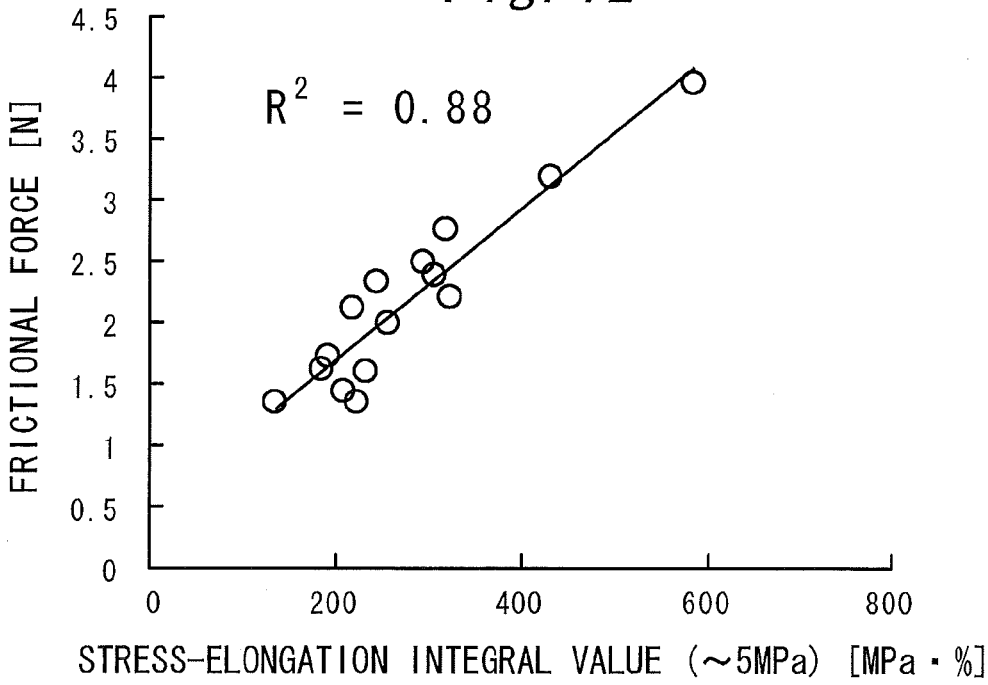
FIG. 12 is a graph showing a correlation between an integral value of stress-elongation up to 5 MPa and a frictional force.
Figure 13:
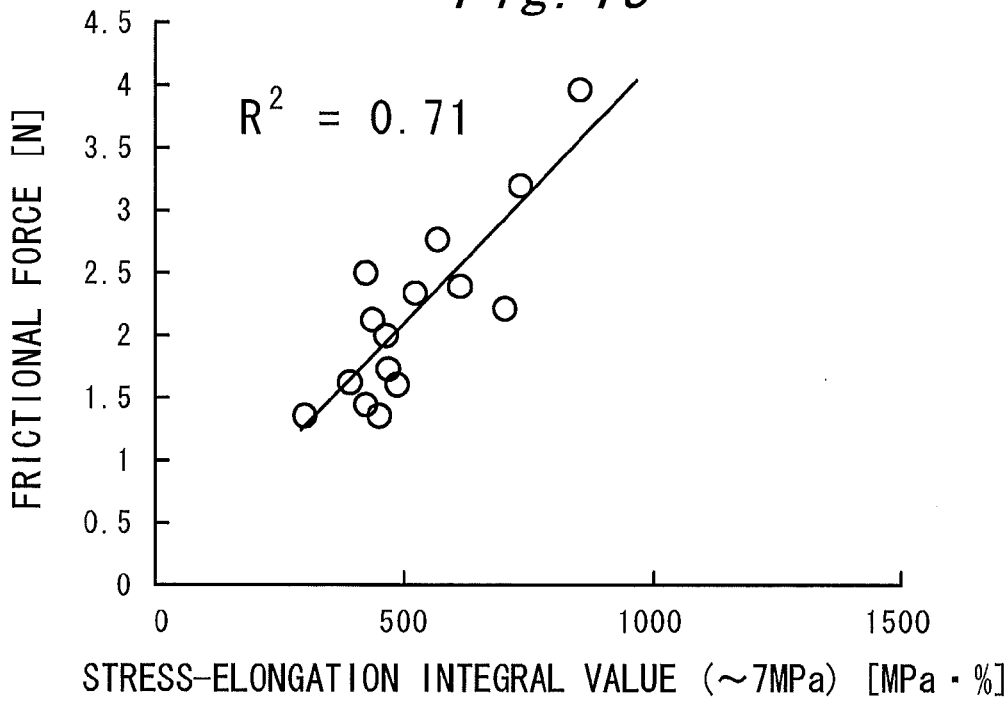
FIG. 13 is a graph showing a correlation between an integral value of stress-elongation up to 7 MPa and a frictional force.
Figure 14:
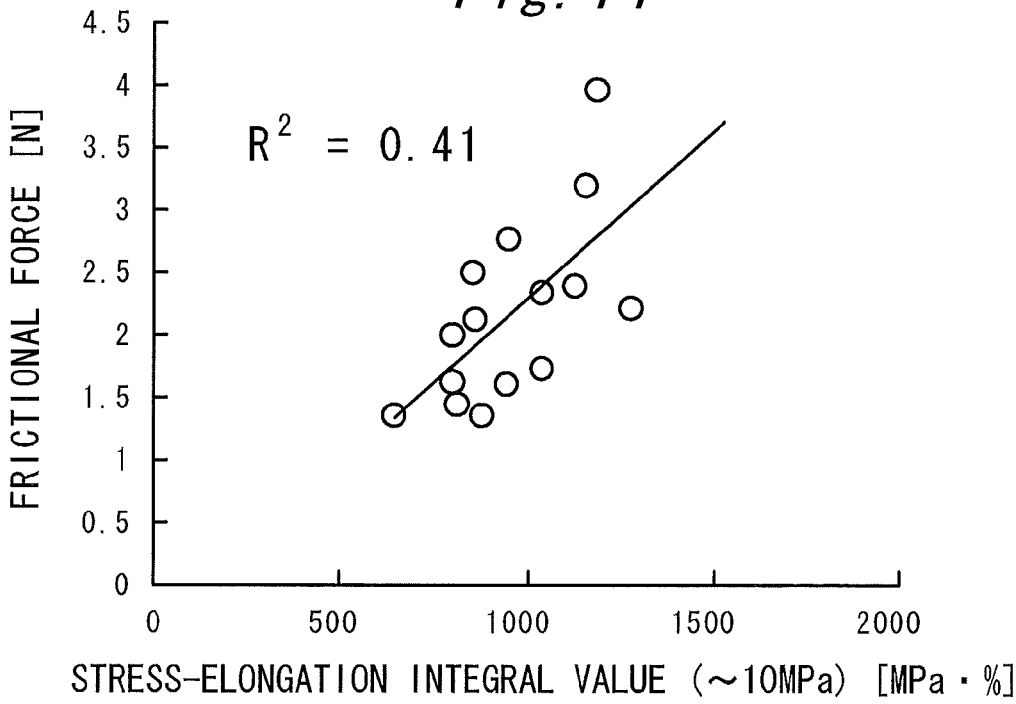
FIG. 14 is a graph showing a correlation between an integral value of stress-elongation up to 10 MPa and a frictional force.

In FIG. 10, measurement examples of a tensile stress-elongation test of polyurethane rubber which is as a common material of the cleaning blade 27, according to JIS K 6301, are shown. In the present invention, an integral value (MPa·%) of stress-elongation obtained by integrating the stress value with respect to an elongation percentage from an elongation percentage of 0% to an elongation percentage at which the stress is a predetermined stress in such the test results, that is, an area of a hatch portion (the case where an integration range is to an elongation percentage at which the stress is 10 MPa) in FIG. 10 is used as a measure of material characteristics of the cleaning blade 27.

Figure 15:
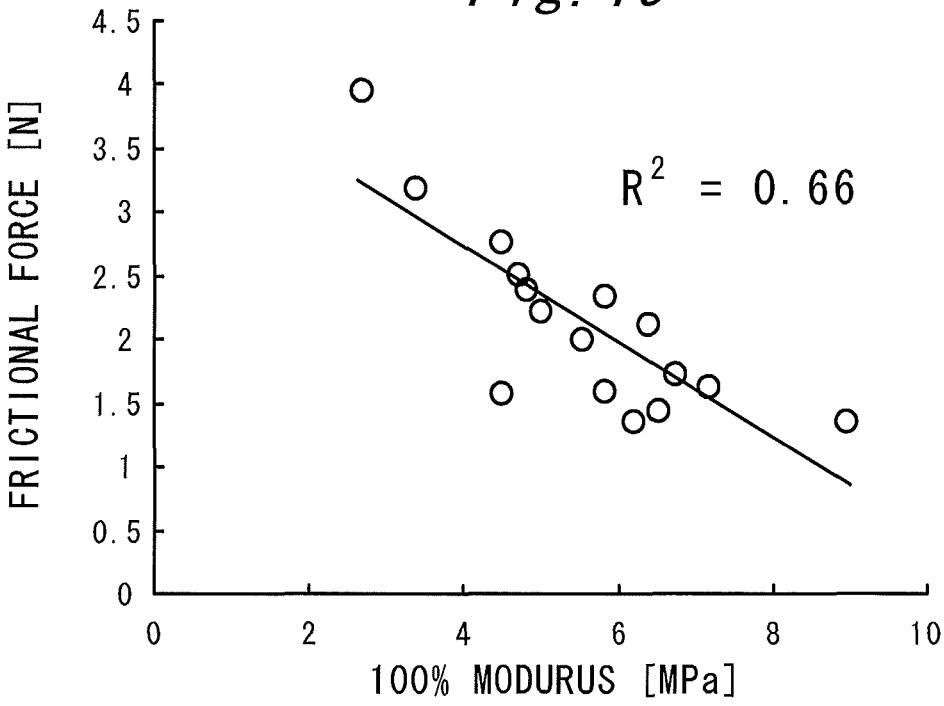
FIG. 15 is a graph showing a correlation between 100% modulus and a frictional force.

In FIGS. 11 to 14, are shown relationships between the integral value of stress-elongation in which the tensile stress-elongation test was carried out on a plurality of different materials and upper limits of an integration range are set at elongation percentages corresponding to the stress of 3 MPa, 5 MPa, 7 MPa and 10 MPa, respectively and a rotation torque of the photoconductor 8 at the time of applying the cleaning blades 27 composed of these materials to the image forming apparatus 1, that is, a frictional force between the photoconductor 8 and the cleaning blade 27. Further, FIG. 15 shows a relationship between 100% modulus which is a conventional index of material characteristics and the frictional force between the photoconductor 8 and the cleaning blade 27.

A determination coefficient (the square of correlation coefficient) of the integral value of stress-elongation and the frictional force between the photoconductor 8 and the cleaning blade 27 was 0.85 based on a integration range to 3 MPa, 0.88 based on a integration range to 5 MPa, 0.71 based on a integration range to 7 MPa, and 0.41 based on a integration range to 10 MPa. Moreover, the determination coefficient of the 100% modulus which is hitherto employed and the frictional force was 0.66.

From these results, it was verified that in the image forming apparatus 1, a characteristic of the material of the cleaning blade 27 is represented more accurately than the conventional 100% modulus by the integral value of stress-elongation in which the upper limits of an integration range are set at elongation percentages corresponding to the stress of 3 MPa to 7 MPa, than the conventional 100% modulus.

Since the stress which acts on the cleaning blade 27 depends on a force (25 N/m in the present embodiment) which presses the cleaning blade 27 against the photoconductor 8, a preferred upper limit of the integration range is thought to be varied by the force pressing the cleaning blade 27. However, generally, the force pressing the cleaning blade in the image forming apparatus which applies a lubricant to the photoconductor does not differ substantially from 25 N/m as in the present embodiment. Therefore, in the type of image forming apparatus which applies a lubricant to the photoconductor, it is desired that the upper limit of the integration range is set at an elongation percentage corresponding to the stress of about 5 MPa.

FIG. 16 shows a relationship between the integral value of stress-elongation in which an upper limit of an integration range is an elongation percentage corresponding to the stress of 5 MPa and the occurrence of defective cleaning after a predetermined durability test on various materials. In this durability test, a contact angle of the cleaning blade 27 relative to the photoconductor 8 (angle between a direction of a tangent line on a downstream side in a rotation direction of the photoconductor 8 and a side surface 28 of the cleaning blade 27) was set at 10°, and 200000 sheets of color images were formed at a printing speed of 55 sheets/min, and then three sheets of whole solid images were formed and then one sheet of whole white solid image was formed, and the presence or absence of image noise due to defective cleaning in the formed white solid image was observed. Furthermore, this time, the apparent friction coefficient μ of the photoconductor 8 was changed by adjusting a force pressing the solid lubricant 25 against the brush roller 24 to change an amount of the lubricant to be applied, and the cleaning condition after the durability test was observed. Here, a symbol O indicates a level of no occurrence of image noise, a symbol Δ indicates a level of image noise slightly recognized, and a symbol x indicates a level of image noise sufficiently recognized.

As a result of this, as shown in FIG. 16, it was verified that when the apparent friction coefficient is 0.25 or less, if the integral value of stress-elongation with 5 MPa of upper limit of an integration range is 300 MPa·%, a good cleaning condition is also achieved after the durability test.

Figures 17, 18:
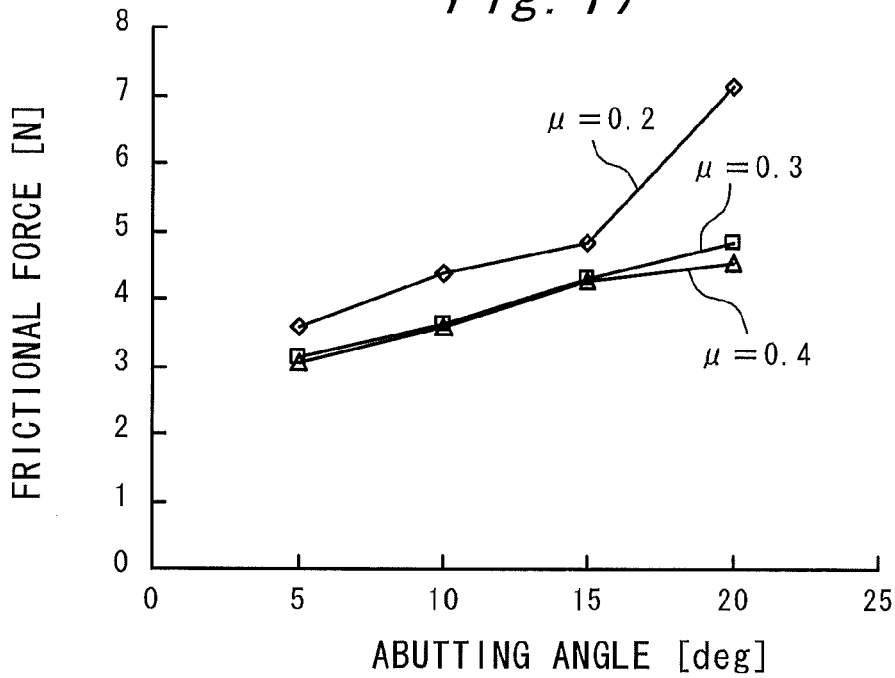
FIG. 17 is a graph showing a relationship between a contact angle of the cleaning blade and a frictional force.
FIG. 18 is a table showing the contact angles of the cleaning blade and the states of cleaning after a durability test.

Furthermore, a relationship between the contact angle of the cleaning blade 27 and the frictional force is shown in FIG. 17. It is found that the frictional force is reduced more as the contact angle getting smaller, regardless of the apparent friction coefficient of the photoconductor 8. In addition, when the friction coefficient is 0.2 or less, if the contact angle is 20°, a stick-slip vibration in which the edge 30 of the cleaning blade 27 vibrates is generated. Accordingly, the contact angle of the cleaning blade 27 is preferably set at 15° or less.

Furthermore, the contact angle of the cleaning blade 27 was varied and cleaning performance after the durability test described above was evaluated. As shown in FIG. 18, the obtained cleaning condition gets better generally as the contact angle of the cleaning blade 27 gets smaller in accordance with the frictional forces in FIG. 17, but when the contact angle is less than 5°, the cleaning condition is significantly deteriorated. The reason for this is that the cleaning blade 27 becomes a state in which only the side surface 28 of the cleaning blade 27 is abutted against the photoconductor 8 and the edge 30 is lifted from the photoconductor 8, which is called a belly abutting state.

As described above, the method for selecting material of cleaning blade according to the present invention is to select a material which shows that particularly in the tensile stress-elongation test according to JIS K 6301, the definite integral of a tensile stress with respect to an elongation percentage on an interval of the elongation percentage corresponding to from the stress of zero to the stress of 5 MPa is 300 MPa or less.

This condition is effective when an apparent friction coefficient of the photoconductor is 0.25 or less, and the contact angle of the cleaning blade should be 5° or more and 15° or less.

Description Of The Reference Numerals And Symbols

1 image forming apparatus
8 photoconductor (image carrying member)
12 lubricant application device
13 cleaner
27 cleaning blade
28 side surface
29 tip face
30 edge

The invention claimed is:

1. An image forming apparatus, comprising an image carrying member which carries an image composed of a developer, a lubricant application device which applies a lubricant onto said image carrying member, and a cleaning blade which abuts against said image carrying member to scrape said developer, wherein said cleaning blade is formed of a material whose tensile stress-elongation test shows that the definite integral of a tensile stress with respect to an elongation percentage on an interval between the elongation percentage of zero and the elongation percentage at which the stress is a predetermined value of about 5 MPa is a predetermined upper limit value of about 300 MPa·% or less.

2. The image forming apparatus according to claim 1, wherein a contact angle of said cleaning blade relative to said image carrying member is 5° or more and 15° or less.

3. A method for selecting a material of a cleaning blade which abuts against an image carrying member to which a lubricant is applied to scrape a developer, comprising steps of determining a tensile stress of a material by a tensile stress-elongation test; and selecting a material whose tensile stress-elongation test shows that the definite integral of a tensile stress with respect to an elongation percentage on an interval between the elongation percentage of zero and the elongation percentage at which the stress is a predetermined value of about 5 MPa is a predetermined upper limit value of 300 MPa·% or less.

* * * * *